United States Patent [19]

Kranz et al.

[11] 3,954,167

[45] May 4, 1976

[54] HIGH SPEED PRINTER

[75] Inventors: Raymond E. Kranz, Mount Prospect; Benjamin M. Starr, Lake Forest, both of Ill.

[73] Assignee: Extel Corporation, Northbrook, Ill.

[22] Filed: Oct. 17, 1974

[21] Appl. No.: 515,509

[52] U.S. Cl. ..... 197/165
[51] Int. Cl.[2] ..... B41J 33/518
[58] Field of Search ..... 197/165, 160, 151

[56] References Cited

UNITED STATES PATENTS

| | | | |
|---|---|---|---|
| 2,972,402 | 2/1961 | Howard et al. | 197/165 |
| 3,026,987 | 3/1962 | Gather | 197/165 X |
| 3,613,857 | 10/1971 | Thevis et al. | 197/151 |
| 3,670,861 | 6/1972 | Zenner et al. | 197/82 X |

*Primary Examiner*—Anton O. Oechsle
*Attorney, Agent, or Firm*—Kinzer, Plyer, Dorn & McEachran

[57] ABSTRACT

Ribbon reversing mechanism in a high speed printer (telecircuitry) including a ribbon driving stepping motor and a print head drive motor both incrementally driven by pulses from the telegraph circuit. The gear ratios in the ribbon drive train are chosen to ensure that the ribbon is advanced in increments different than the increments of print head movement. The ends of the ribbon are provided with eyelets which are sensed by a mechanism which operates to reverse the ribbon driving motor.

8 Claims, 5 Drawing Figures

HIGH SPEED PRINTER

This invention relates to a dot matrix teleprinter and in particular to a ribbon reversing mechanism to be used therewith.

A dot matrix teleprinter prints information derived from telecircuitry by means of a printing head which embodies a plurality of needlelike printing wires operated selectively in response to the pulses in the telecircuitry representing the characters to be printed. One form of such printer is disclosed in U.S. Pat. No. 3,670,861 where the printing head carriage, in the course of printing a character, advances in a series of high frequency increments, eight steps for each character, with five steps devoted to actual printing and the remaining three steps affording space between adjacent characters. In each step one or more of the printing wires are actuated to form a corresponding number of dots as an incident to pressing the paper against the supporting platen roll. High speed is involved in that normal operation produces approximately ten characters per second, meaning, in the example given, approximately eighty steps per second.

In accomplishing this resort is had to a stepping motor which rotates a timing belt to which the printing head carriage is attached, the stepping motor being energized by the telegraph circuit whereby on the completion of one circuit pulse in which the printing wires are excited, the printing head matrix is advanced one step to continue the profile of the dot character being printed on the next pulse.

The paper may be of the pressure responsive type in which coloration is obtained as the result of wire impingement. The present invention is concerned with interposing a ribbon between the printing head matrix and the sheet of paper so that the printing wires are effective to transfer ink from the ribbon to the paper.

The teleprinter of the aforesaid patent has proven to be eminently satisfactory, and one object of the present invention is to develop a ribbon reversing mechanism which can be readily mounted thereto, including a reversing stepping motor energized by the teleprinter circuit. Other objects of the invention are to employ sensors to detect the end of ribbon pay-out and reverse the motor to start ribbon feed in the opposite direction; to step the ribbon by an increment different from the increment of printing head movement so that the ribbon will not be used repeatedly at the same spot; and to develop unique mechanisms and circuitry for reversing the stepping motor.

Figure 1:
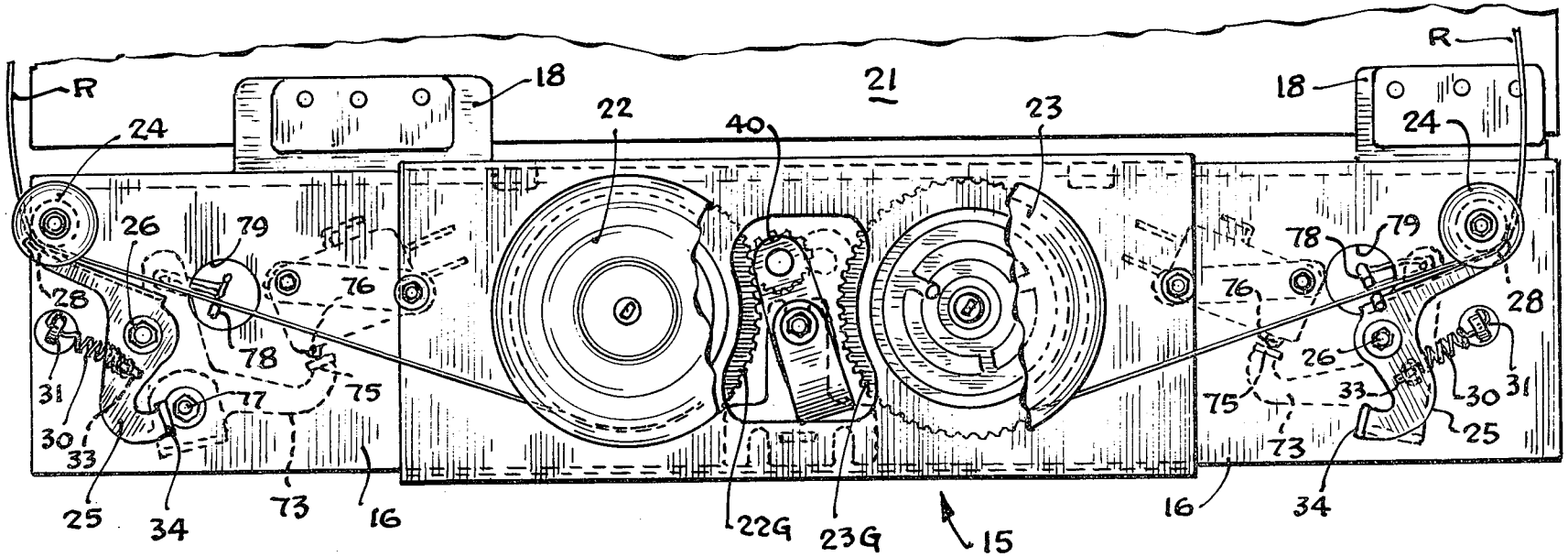
FIG. 1 is a top plan view of the ribbon reversing mechanism of the present invention.

Referring to FIG. 1, the ribbon reversing mechanism 15 of the present invention is supported by an elongated mounting plate 16 having a pair of dependent support brackets 18 at opposed ends thereof adapted to be fastened to the base 21 of the teleprinter disclosed in U.S. Pat. No. 3,670,861 as illustrative of a preferred embodiment of the invention. When so mounted the support plate 16 is disposed in a horizontal plane.

Figure 2:
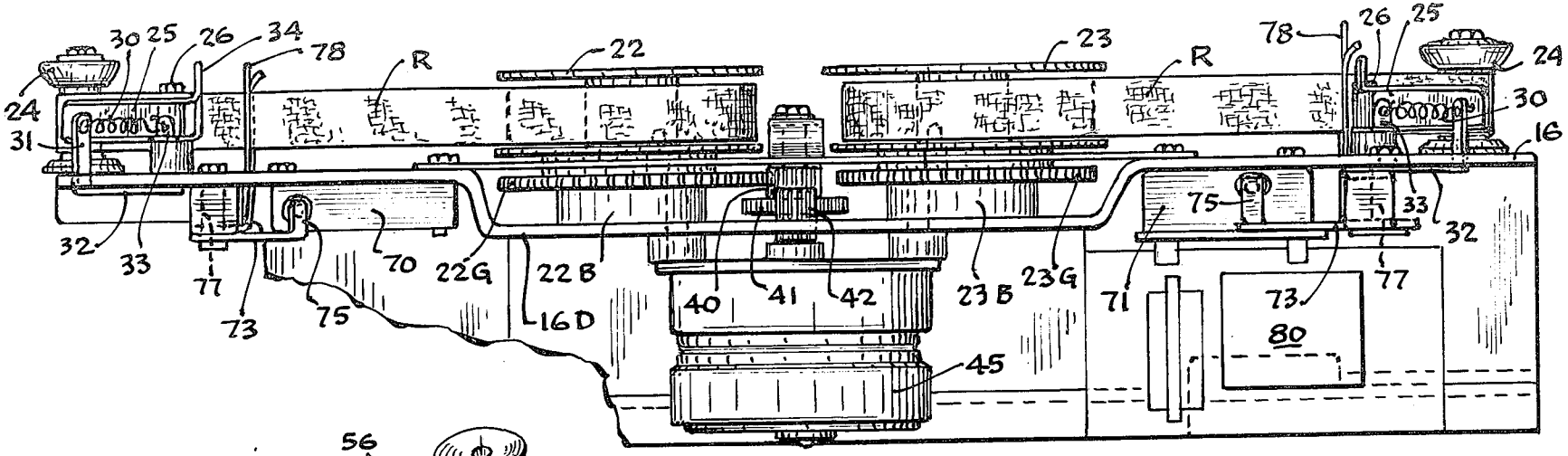
FIG. 2 is a front elevation of the mechanism shown in FIG. 1.

The ribbon R, FIGS. 1 and 2, is supplied by a pair of spools 22 and 23. Depending upon the direction of ribbon feed, one spool will constitute a supply spool and the other spool will constitute a take-up spool.

To guide the ribbon, a pair of stationary guides 24, FIGS. 1 and 2, of low friction plastic are supported in vertical relation at opposite ends of the mounting plate 16. To tension the ribbon, a pair of brake arms 25 are mounted on posts 26 projecting upwardly from the upper side of the mounting plate 16. Each brake arm is of S-form and includes a front finger 28 serving to apply a slight clamping force holding the ribbon against the related stationary guide. A coil spring 30 has one end anchored to a fixed stud 31 bent from a stud plate 32 secured to the underside of the mounting plate, so as to project upwardly through an aperture in the mounting plate. The opposite end of the spring 30 is secured to a lug 33 projecting from the brake arm lever 25. The side of the brake arm 25 opposite the pressure applying finger 28 is provided with a tab 34 permitting digital pressure to be applied to release the brake if desired.

To feed the ribbon, each spool is provided with a gear, 22G and 23G, FIGS. 1 and 2. In order that the gears may be neatly confined and accommodated within narrow limits, the mounting plate 16, as shown in FIG. 2, is dished at the center, 16D. Each of the gears 22G and 23G is part of a one-piece plastic moulding which also affords respective bushings 22B and 23B mounted for rotation on spindles or posts 35, FIG. 3, in turn secured in locating apertures 36 presented in the dished portion 16D of the mounting plate 16. Thus it will be seen, FIGS. 2 and 3, that the ribbon spools are mounted for rotation on vertical axes represented by the posts 35. Each post 35 is provided with a bearing surface 37 on which the related gear and bushing assembly is free to turn.

In order to rotate and incrementally step one of the driven gears of the spools, a drive gear 40, FIG. 1, is disposed between the gears 22G and 23G and is selectively engageable with one or the other depending upon the required direction of ribbon feed. As shown in FIG. 2, gear 40 is conveniently disposed within the space afforded by the dished portion 16D of the mounting plate 16. Drive gear 40 is part of a gear train which also includes an intermediate gear 41 co-molded therewith from plastic. Gear 41 in turn is driven by a pinion gear 42 fastened to a shaft 43, FIG. 3, of a reversing stepping motor 45.

In order that gear 40 may be engaged with the driven gear of one of the spools, it is supported for pivotal movement between the gears 22G and 23G, shifting from one to the other when the direction of motor rotation is reversed. A friction device assures the gear will shift merely as an incident to motor reversal, as will be explained.

The drive gear 40 and the related gear 41 are mounted for rotation at one end of a lever arm 50, FIG. 1, in turn mounted for pivotal movement on a support bracket 52 fastened to the dished portion of the mounting plate 16.

Figure 3:
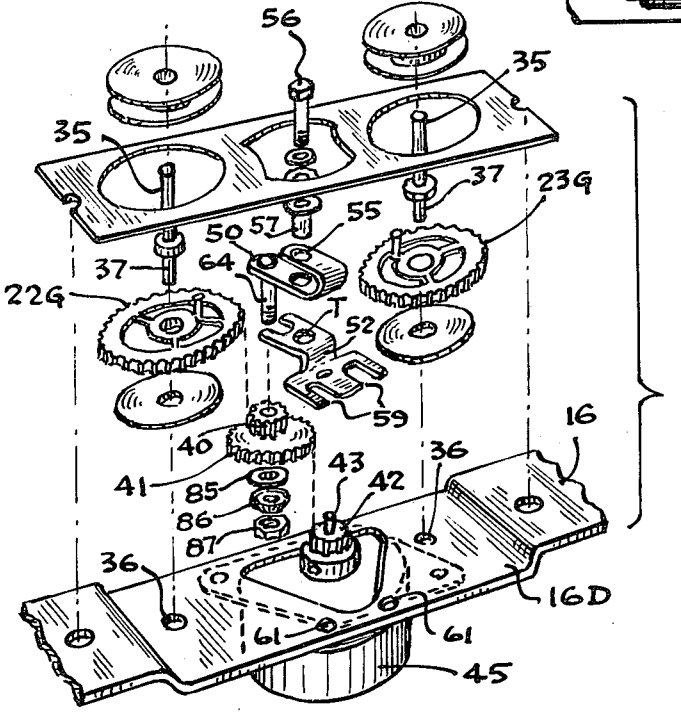
FIG. 3 is an exploded view of the gear train.

The support lever 50 is in the form of a U-shaped arm as shown in FIG. 3. It is provided with apertures as 55 for receiving a mounting screw 56 extendable through a support bushing 57 for lever 50 and secured in a tapped opening T in the support bracket 52.

A pair of bifurcations 59 in the support 52 register with apertures 61 in the mounting plate so that mounting screws may be employed to secure the support 52 in place.

The pivoting lever 50 has an extended end in which a threaded stud 64 is mounted which rotatably supports the gear assembly 40–41.

In order to sense the approaching end of ribbon pay-out and to reverse the motor in a manner to be explained in more detail, a pair of switches 70 and 71, FIG. 2, are located on the underside of the mounting plate adjacent each end. Associated with each switch is a switch operating lever 73. Each switch operating lever has one arm provided with a finger 75 in position to engage the related switch contact button 76, FIG. 1.

The medial portion of each switch operating lever is pivotally mounted on a post 77 at the underside of the mounting plate 16. The arm of each switch operating lever opposite the switch contact finger 75 is provided with a sensing finger 78 of split form projecting upwardly through an aperture 79 in the mounting plate. The sensing finger thus has two fingers affording a slot through which the ribbon is extended, and each ribbon, near the end thereof, is provided with a metal eyelet which is trapped in the slot of the sensing finger 78 to indicate the approaching end of ribbon pay-out. When the eyelet or metal element is thus presented to the sensing finger the next tug on the ribbon, tending to advance the ribbon, results in pivotal movement of the related switch operating arm, causing the finger 75 to actuate the related switch button. When the switch is thus actuated, the circuit to the reversing motor is reversed and the next driving impulse results in gear 40 being displaced from one spool gear to the other.

For example, gear 40, FIG. 1, is in position to drive gear 22G so that spool 22 is the take-up spool; ribbon feed is counter-clockwise. When the eyelet E on the ribbon, indicating the end of ribbon pay-out from spool 23, is trapped in the sensing finger 78, FIG. 5, the next tug on the ribbon pivots the related switch operating arm 73 clockwise, finger 75 operates the button of switch 71, reversing the stepping motor 45 and gear 40 is shifted clockwise, FIG. 1, to engage and drive gear 23G, whereupon spool 23 becomes the take-up spool.

The reversing motor 45 is energized by the telegraph circuit. This is equally true of the drive motor employed to produce incremental spacing of the printing head as disclosed in the aforesaid patent. The timing of the pulses to the two motors is therefore the same, and in order to step the ribbon by an incremental distance different from that of the printing head, the gear ratios are chosen so that this difference will prevail. The same effect could be realized by other means but doubtless at greater expense compared to adjustment in the gear train.

Figure 4:
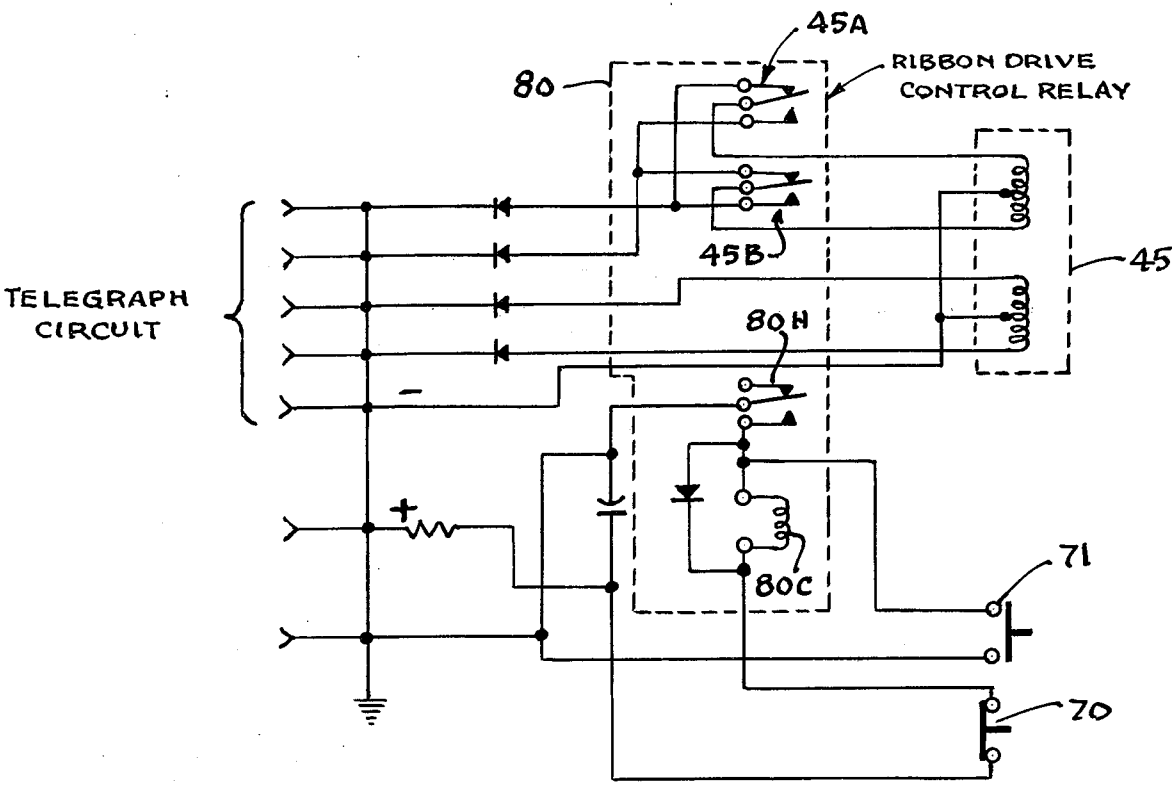
FIG. 4 is a wiring diagram.

Circuitry is shown in FIG. 4 which is self-explanatory for the most part. Motor 45, as already noted, is reversing. The motor reversing contacts 45A and 45B are embodied in a relay 80 which is also shown in FIG. 2. One of the switches (70) is normally closed; the other (71) is normally open. However, when switch 71 is operated as explained above in connection with FIG. 5, closing its related contacts, FIG. 4, a circuit from plus (+) to minus (−) is completed for the relay coil 80C. The contacts 45A and 45B are reversed, reversing the motor. At the same time, a set of holding contacts 80H for the relay coil are closed so that the relay coil continues to be energized through normally closed relay control switch 70, even though relay control switch 71 once again returns to its normally open position once the ribbon is reversed to displace the eyelet E, FIG. 5.

Figure 5:
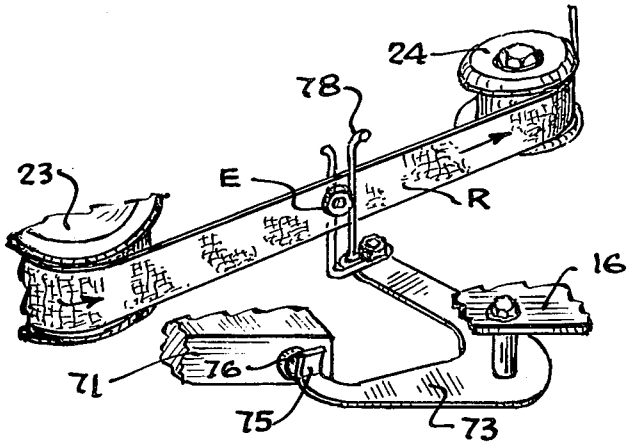
FIG. 5 is a detail perspective view of a switch operating lever.

Then, when the opposite end of ribbon pay-out is reached, switch 70 is opened in the fashion explained in connection with FIG. 5; the relay coil is de-energized and the motor contacts 45A and 45B are reversed to reverse the motor. The ribbon is reversed, and switch 70 is closed to condition the circuit for reversal when the ribbon eyelet once more attains the FIG. 5 position to produce operation of switch 71. It will be appreciated that indicia other than the eyelets E may be employed to identify the approaching end of ribbon pay-out.

In order to effectively shift gear 40–41 as an incident to reversing the motor, a friction device is adjusted to prevent free wheeling of gear 40–41 on stud 64. Consequently, gear 41 uses gear 42 as a track and is not rotated by gear 42 when the motor reverses; instead, gear 41 walks on the teeth of gear 42 until gear 40 is engaged with gear 22 or 23.

The device comprises a brake or friction plate 85, a washer-type spring 86 and a lock nut 87 which secures the plate and spring to the threaded end of stud 64. Nut 87 is tightened sufficiently to prevent free wheeling of gear assembly 40–41 on stud 64 while assuring that the gear assembly shifts from one ribbon feed gear to the other when motor 45 is reversed. Once gear 40–41 is shifted to its running position, it is held in place by the gear tooth loads between gear 40–41 and whichever of gears 22 or 23 is engaged; the gear tooth load overcomes the resistance of the brake.

I claim:

1. In combination with a high speed teleprinter apparatus wherein characters are printed by a high speed printing head advancing in short high frequency increments in response to a telegraph circuit, a ribbon reversing mechanism comprising:

a pair of spools for supporting the ribbon, each spool having a driven gear;

a gear train including a pinion gear selectively engageable with each of the driven gears to feed the ribbon in one direction or the other;

a reversing stepping motor energized by the telegraph circuit for incrementally rotating the pinion gear;

means to establish an increment of movement of the ribbon different in dimension compared to the increment of movement of the printing head; and means for reversing the stepping motor after a predetermined length of ribbon has been extended.

2. Apparatus according to claim 1 wherein the means for reversing the stepping motor comprises contacts for reversing the polarity of the motor, a relay for operating said contacts, and a pair of relay control switches respectively operated by indicia on the ribbon evidencing the end of ribbon pay-out.

3. Apparatus according to claim 1 wherein the gear ratios in the gear train are such that incremental movement of the ribbon is of different dimension compared to incremental movement of the printing head.

4. Apparatus according to claim 1 wherein the pinion gear is frictionally secured on a shaft against free wheeling and is so supported as to shift from one driven gear to the other as an incident to reversing the stepping motor.

5. Apparatus according to claim 2 wherein the gear ratios in the gear train are such that incremental movement of the ribbon is of different dimension compared to incremental movement of the printing head.

6. Apparatus according to claim 2 wherein the pinion gear is frictionally secured on a shaft against free wheeling and is supported for internal movement, shifting from one driven gear to the other as an incident to reversing the stepping motor.

7. Apparatus according to claim 3 wherein the pinion gear is frictionally secured on a shaft against free wheeling and is so supported as to shift from one driven gear to the other as an incident to reversing the stepping motor.

8. Apparatus according to claim 7 wherein the means for reversing the stepping motor comprises contacts for reversing the polarity of the motor, a relay for operating said contacts, and a pair of relay control switches respectively operated by indicia on the ribbon evidencing the end of ribbon pay-out.

* * * * *